US011121510B2

(12) United States Patent
Kodaira et al.

(10) Patent No.: US 11,121,510 B2
(45) Date of Patent: Sep. 14, 2021

(54) CONNECTOR

(71) Applicant: YAZAKI CORPORATION, Tokyo (JP)

(72) Inventors: Erika Kodaira, Utsunomiya (JP); Tomoyuki Miyakawa, Utsunomiya (JP); Tomoyoshi Fukaya, Utsunomiya (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/805,084

(22) Filed: Feb. 28, 2020

(65) Prior Publication Data

US 2020/0313369 A1 Oct. 1, 2020

(30) Foreign Application Priority Data

Mar. 29, 2019 (JP) ..... JP2019-066544

(51) Int. Cl.
*H01R 13/74* (2006.01)

(52) U.S. Cl.
CPC ..... *H01R 13/743* (2013.01)

(58) Field of Classification Search
CPC ..... H01R 13/6273; H01R 13/62938; H01R 13/743; H01R 13/641; H01R 13/74
See application file for complete search history.

(56) References Cited

U.S. PATENT DOCUMENTS

2007/0212933 A1* 9/2007 Kondou ..... H01R 13/6273 439/541.5
2008/0081504 A1* 4/2008 Kobayashi ..... H01R 13/641 439/354
2013/0196537 A1* 8/2013 Klein ..... H01R 13/743 439/563
2016/0126671 A1* 5/2016 Ebihara ..... H01R 13/62938 439/660

FOREIGN PATENT DOCUMENTS

EP 1 801 935 A1 6/2007
EP 2 141 778 A1 1/2010
FR 1 570 875 A 6/1969
JP S59-80982 U 5/1984
JP 7-263087 A 10/1995

* cited by examiner

*Primary Examiner* — Jean F Duverne
(74) *Attorney, Agent, or Firm* — Kenealy Vaidya LLP

(57) ABSTRACT

A connector configured to be assembled to a plate-shaped panel in a state of being inserted into a through hole of the plate-shaped panel, the connector includes a body, and a first locking portion and a second locking portion. The body is configured to be inserted into the through hole in a predetermined insertion direction. The first locking portion and the second locking portion are integrally provided with the body and configured to be engaged with a circumferential edge portion of the through hole in a state where the circumferential edge portion is clamped in the insertion direction.

4 Claims, 6 Drawing Sheets

CONNECTOR

CROSS REFERENCE TO RELATED APPLICATIONS

This application claims priority from Japanese Patent Application No. 2019-066544 filed on Mar. 29, 2019, the entire contents of which are incorporated herein by reference.

BACKGROUND OF THE INVENTION

Field of the Invention

The present invention relates to a connector configured to be attached to a plate-shaped panel in a state of being inserted into a through hole provided in the panel.

Description of Related Art

Connectors have been proposed in the related art to be inserted and locked in a through hole provided in a plate-shaped panel constituting a vehicle body (for example, an instrument panel) of a vehicle. For example, one of the connectors in the related art includes a cantilever-shaped locking arm and a locking sheet extending from a connector body. When the connector is assembled to the panel, the connector is locked to the panel in a state where a circumferential edge portion of the through hole is clamped by the locking arm and the locking sheet. The connector utilizes the fact that the locking arm is elastically deformable to prevent relative movement (so-called rattling) of the connector to the panel (for example, see Patent Literature 1).

[Patent Literature 1] JP-A-H7-263087

When the connector in the related art is assembled to the panel, a moving amount of the connector after the connector is inserted into the through hole of the panel is mainly restricted by the locking arm. Specifically, an operator moves the connector to the panel until the locking arm is abutted against the circumferential edge portion of the through hole and the connector does not proceed further. Accordingly, the locking arm may be strongly pressed against the panel depending on the operator and unintended damages or the like may occur in the locking arm. It is desirable for the connector to have sufficient durability for assembly to the panel so that such damages may be avoided as much as possible.

SUMMARY

One or more embodiments provide a connector having good durability for assembly to a panel.

In an aspect (1), one or more embodiments provide a connector configured to be assembled to a plate-shaped panel in a state of being inserted into a through hole of the plate-shaped panel. The connector includes a body, and a first locking portion and a second locking portion. The body is configured to be inserted into the through hole in a predetermined insertion direction. The first locking portion and the second locking portion are integrally provided with the body and configured to be engaged with a circumferential edge portion of the through hole in a state where the circumferential edge portion is clamped in the insertion direction. At least one of the first locking portion and the second locking portion has a shape of a double end-supported beam including a pair of beam-shaped portions extending from the body and a protrusion portion connecting free ends of the pair of beam-shaped portions and protruding toward the plate-shaped panel.

In an aspect (2), the protrusion portion may include a first part connected to one of the pair of beam-shaped portions and extending toward the plate-shaped panel, a second part connected to the other of the pair of beam-shaped portions and extending toward the plate-shaped panel, and a connection part defining a gap between the first part and the second part and connecting the first part and the second part.

In an aspect (3), at least one of the pair of beam-shaped portions may have a shape extending from the body so as to outwardly expand from an opening region of the through hole when the connector is assembled to the plate-shaped panel.

According to the aspect (1), at least one of the first locking portion and the second locking portion that lock the connector to the panel has a shape of a double end-supported beam. Therefore, even when a locking portion (at least one of the first locking portion and the second locking portion) is strongly pressed against the panel when the connector is assembled to the panel, unintended damages or the like of the locking portion can be prevented as compared with the connector in the related art. In this manner, the connector having the present configuration has good durability for assembly to the panel.

In the connector in the related art, electric wires and the like extending from the connector are caught by the cantilever-shaped locking arm, which may hinder assembly of the connector to the panel. In contrast, the connector having the present configuration includes a locking portion having a shape of a double end-supported beam (at least one of the first locking portion and the second locking portion). Accordingly, it is less likely for the electric wires to hinder the assembly.

According to the aspect (2), the protrusion portion constituting the locking portion (at least one of the first locking portion and the second locking portion) has a shape in which the first part and the second part provided with a gap therebetween are connected by the connection portion. Therefore, as compared with a case where there is no such gap, a force received by the protrusion portion from the panel is dispersed throughout the locking portion when the locking portion is abutted against the panel and excessive stress concentration is less likely to occur around the protrusion portion. Therefore, the connector having the present configuration has better durability for assembly to the panel.

According to the aspect (3), the beam-shaped portion constituting the locking portion (at least one of the first locking portion and the second locking portion) has a shape extending from the body so as to outwardly expand from the opening region of the through hole. Therefore, the beam-shaped portion can be made longer than in a case where the beam-shaped portion has a length enough to fit within the opening region of the through hole. As a result, a range in which the beam-shaped portion is elastically deformable is widened and the durability for the assembly to the panel can be further improved.

According to one or more embodiments, it is possible to provide a connector having good durability for assembly to a panel.

The present invention is briefly described above. Details of the present invention are further clarified by reading a mode for carrying out the present invention described below with reference to the accompanying drawings.

DETAILED DESCRIPTION

Embodiment

Hereinafter, a connector 1 according to an embodiment will be described with reference to the drawings.

As shown in FIGS. 1 to 4B (in particular, FIGS. 4A and 4B), the connector 1 is configured to be attached to a plate-shaped panel P in a state of being inserted into a through hole Pa provided in the panel P. The connector 1 is used to be fitted to a mating connector (not shown). An example of the panel P includes a plate-shaped body constituting a vehicle body (for example, an instrument panel) of a vehicle. A. usage example of the connector 1 includes a connector for accessing a failure diagnosis system (a system that is connected to an external device during maintenance or the like and transmits to the external device information on whether an abnormality has occurred in the vehicle) provided in a vehicle. In the present embodiment, the connector 1 accommodates female terminals and the mating connector accommodates male terminals.

Figure 1:
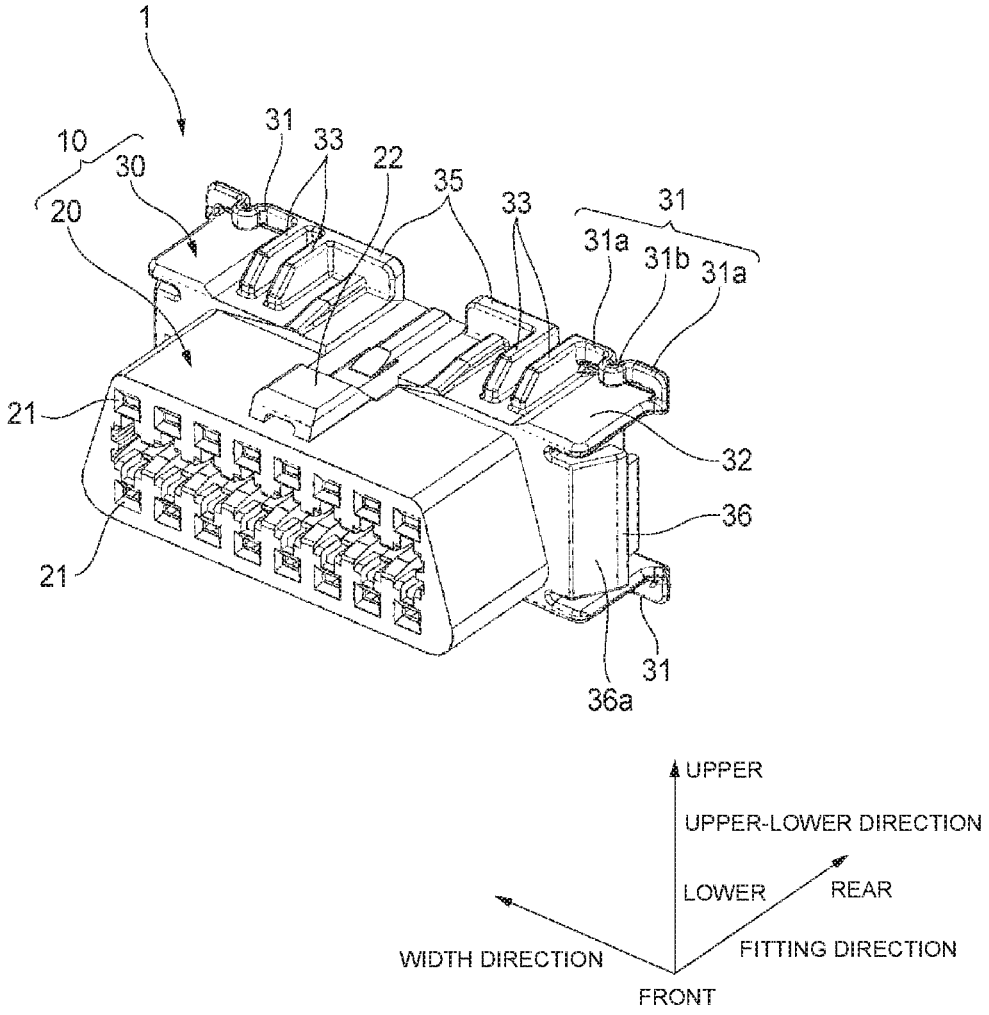
FIG. 1 is a perspective view of a connector according to an embodiment.

Hereinafter, "fitting direction", "width direction", "upper-lower direction", "front", "rear", "upper", and "lower" are defined as is shown in FIG. 1. The "fitting direction", the "width direction", and the "vertical direction" are orthogonal to each other.

As shown in FIG. 1 and the like, the connector 1 includes a connector body 10 formed of resin. The connector body 10 includes a terminal accommodating block portion 20 and a panel assembly portion 30 integrally extending rearward from the terminal accommodating block portion 20. The terminal accommodating block portion 20 has a substantially trapezoidal cross-sectional shape in which the length of its upper surface in the width direction is shorter than the length of its lower surface in the width direction.

The terminal accommodating block portion 20 includes a plurality of terminal accommodating chambers 21 penetrating in the fitting direction. The plurality of terminal accommodating chambers 21 are configured to accommodate and fix a plurality of female terminals (not shown) whose rear sides are connected to electric wires. When the terminal accommodating block portion 20 is connected to a terminal accommodating block portion (not shown) of the mating connector, the connector 1 and the mating connector are fitted and electric conduction between the plurality of female terminals accommodated in the connector 1 and a plurality of male terminals accommodated in the mating connector is achieved, The terminal accommodating block portion 20 includes a convex portion 22 at a central portion of its upper surface. The convex portion 22 protrudes upward and extends in the fitting direction. When the connector 1 is fitted to the mating connector, the convex portion 22 is guided by and inserted into a guide recess (not shown) provided in the terminal accommodating block portion of the mating connector so that axial misalignment between the connector 1 and the mating connector is prevented.

The panel assembly portion 30 includes an arm-shaped locking portion 31 in tour positions on two end portions of its upper surface 32 in the width direction and two end portions of its lower surface in the width direction. The arm-shaped locking portion 31 includes a pair of beam-shaped portions 31*a* extending from the panel assembly portion 30 and a protrusion portion 31*b* connecting free ends of the beam-shaped portions 31*a* to each other and protruding forward toward the panel P in the fitting direction. The arm-shaped locking portion 31 has a shape of a double end-supported beam as a whole.

Figure 3:
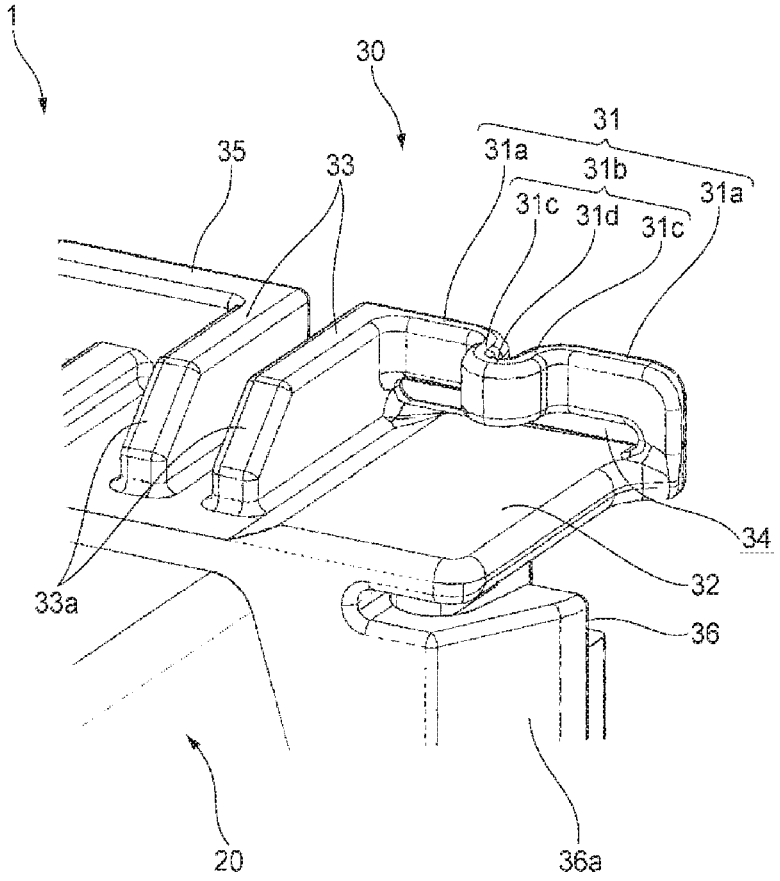
FIG. 3 is an enlarged view of a part of surroundings of an arm-shaped locking portion of the connector in FIG. 1.

As shown in FIG. 3, one of the beam-shaped portions 31*a* extends outward in the width direction from an end portion of the upper surface 32 on a rear side and outer side in the width direction, extends upward, and then extends inward in the width direction. The other one of the beam-shaped portions 31*a* extends outward from an upper end in the upper-lower direction of a rib 33 on a rear side. The rib 33 extends upward from the upper surface 32.

Figure 5:
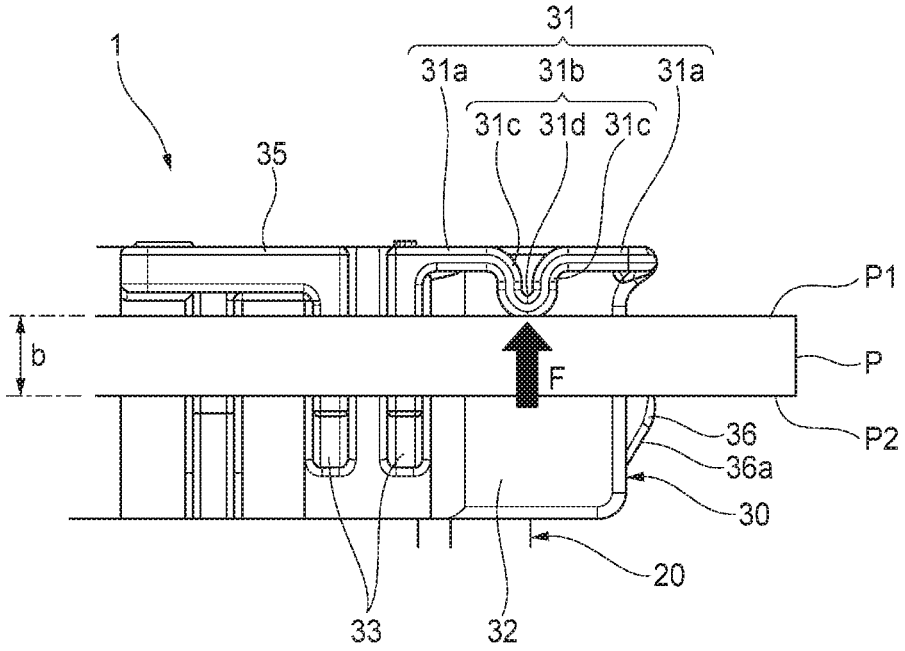
FIG. 5 is a top view of the connector in FIG. 1 and the panel in a state where the connector is assembled to the panel.

The protrusion portion 31*b* has a substantially U shape in a top view and protrudes forward in the fitting direction while connecting the free ends of the pair of beam-shaped portions 31*a* to each other. More specifically, as shown in FIGS. 3 and 5, the protrusion portion 31*b* has a shape in which front ends of a pair of protruding walls 31*c* in the fitting direction are connected by a connection wall 31*d*. The pair of protruding walls 31*c* are connected by the connection wall 31*d* with a gap defined therebetween and do not contact each other in a state of receiving no external force F (see FIGS. 6A and 6B) from the panel P. The arm-shaped locking portion 31 and the upper surface 32 define a gap 34 therebetween. As shown in FIG. 5, when the connector 1 is inserted into the through hole Pa. of the panel P. the arm-shaped locking portion 31 is abutted against a rear panel surface P1 of the through hole Pa in the fitting direction at a circumferential edge portion.

Figure 4A:
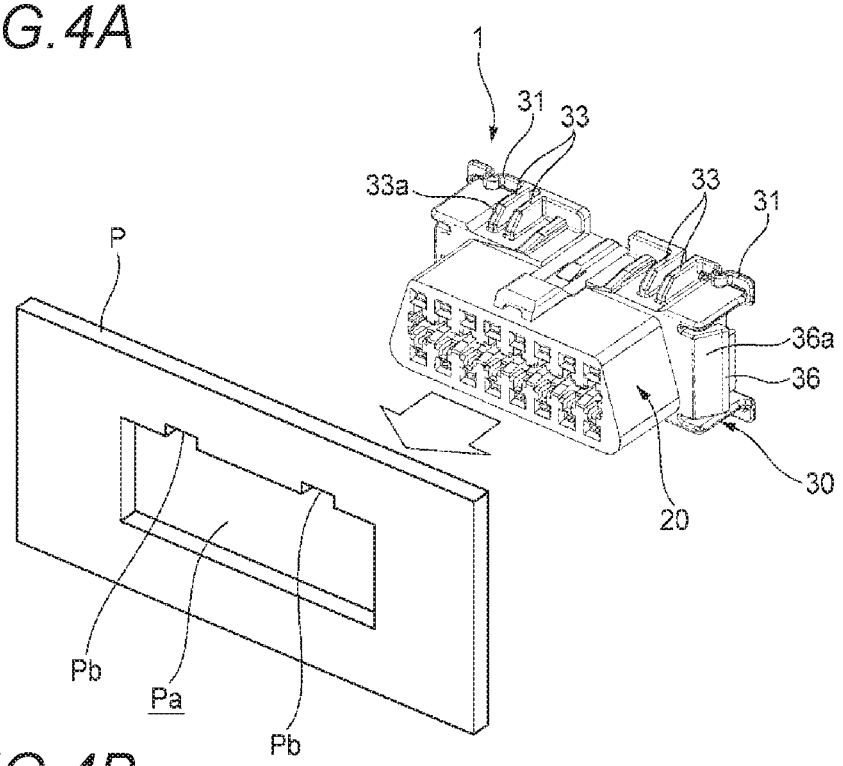
FIG. 4A is a perspective view of the connector in FIG. 1 and a panel to which the connector is to be attached.
Figure 4B:
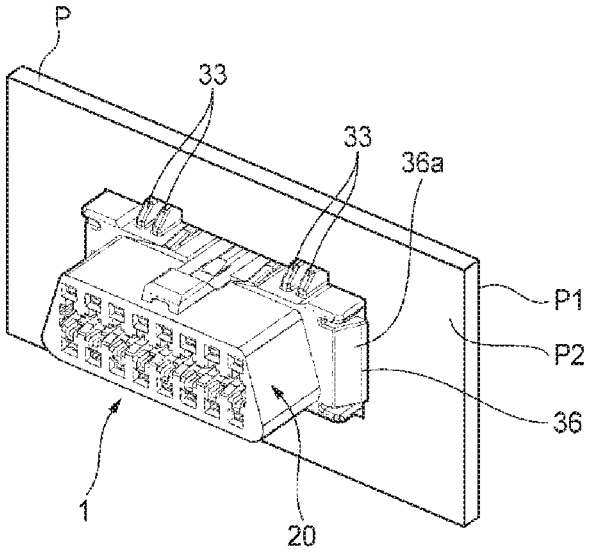
FIG. 4B is a perspective view showing a state where the connector is attached to the panel.

The panel assembly portion 30 includes an engagement claw portion 36 in two positions on its two end portions in the width direction. The engagement claw portion 36 protrudes outward in the width direction from a side surface of the panel assembly portion 30. As shown in FIGS. 4B and 5, when the connector 1 is inserted into the through hole Pa of the panel P, the engagement claw portion 36 engages with a front panel surface P2 of the through hole Pa in the fitting direction at the circumferential edge portion.

Accordingly, the panel P is clamped by the arm-shaped locking portion 31 and the engagement claw portion 36 and the connector 1 is assembled to the panel P without relative movement to the panel P in the fitting direction (rattling prevented).

Here, the engagement claw portion 36 has an inclined surface 36*a* on its front side in the fitting direction. The inclined surface 36*a* is inclined so that a top surface of the engagement claw portion 36 moves outward in the width direction as the panel P moves rearward. The inclined surface 36*a* is provided to facilitate (guide) positioning of the connector 1 in the width direction relative to the through hole Pa when the connector 1 is inserted into the panel P.

On the other hand, the rib 33 of the panel assembly portion 30 has an inclined surface 33*a* on its front side in the fitting direction. The inclined surface 33*a* is inclined so that a top surface of the rib 33 moves upward as the panel P moves rearward. The inclined surface 33*a* is provided to facilitate (guide) positioning of the connector 1 in the upper-lower direction relative to the through hole Pa when the connector 1 is inserted into the panel P. As shown in FIGS. 4A and 4B, the rib 33 also has an effect of facilitating (guiding) positioning of the connector 1 in the width direction by entering a recess Pb provided on an upper side of the through hole Pa at the circumferential edge portion.

Figure 2A:
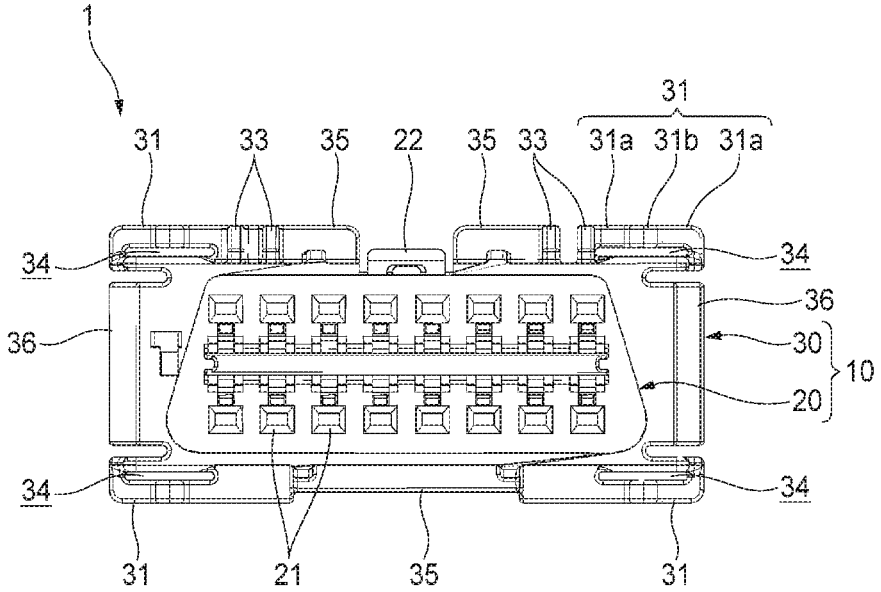
FIG. 2A is a front view of the connector in FIG. 1.
Figure 2B:
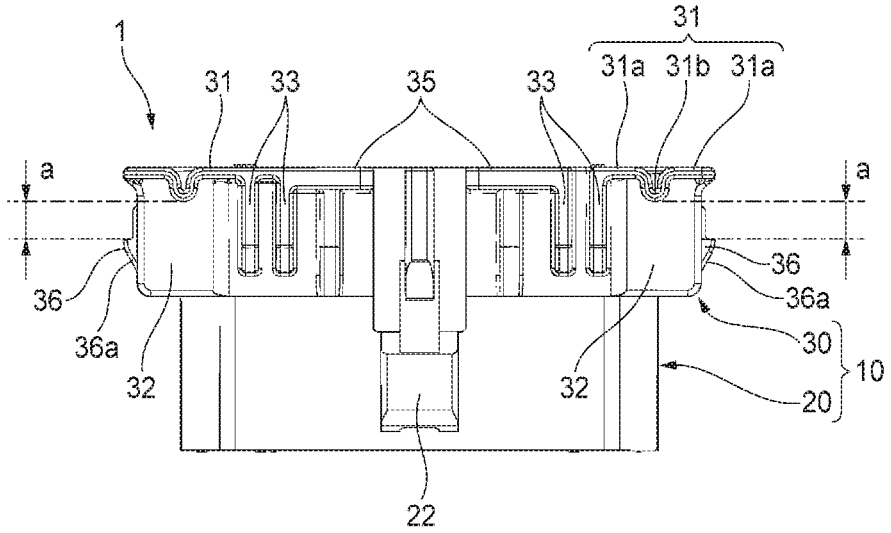
FIG. 2B is a top view of the connector in FIG. 1.

As shown in FIG. 2 and the like, a rear end wall 35 extends inward in the width direction from a rear end of the rib 33. The rear end wall 35 on an upper surface side of the panel assembly portion 30 is divided at a center portion of the panel assembly portion 30 in the width direction and the rear end wall 35 on a lower surface side of the panel assembly portion 30 extends in the width direction without being divided.

Next, procedures for attaching the connector 1 to the panel P will be briefly described with reference to FIGS. 4A, 4B, and 5. Although not shown in the drawings, in practice, a plurality of female terminals are accommodated in the terminal accommodating block portion 20 when the connector 1 is assembled to the panel P and a plurality of electric wires connected to rear end sides of the plurality of female terminals extend rearward from the terminal accommodating block portion 20.

First, as shown in FIG. 4A, the terminal accommodating block portion 20 of the connector 1 is inserted into the through hole Pa of the panel P in a state where the terminal accommodating block portion 20 is forward of the panel assembly portion 30 in the fitting direction, Upon doing so, the terminal accommodating block portion 20 passes through the through hole Pa gradually from its front end in the fitting direction and the inclined surface 36*a* of the engagement claw portion 36 contacts the circumferential edge portion of the through hole Pa. The panel assembly portion 30 is guided in the width direction with the inclination of the inclined surface 36*a* and is thereby positioned in the width direction. Similarly, the inclined surface 33*a* of the rib 33 contacts a circumferential edge portion of the recess Pb and the panel assembly portion 30 is guided in the upper-lower direction with the inclination of the inclined surface 33*a*. By doing so, the panel assembly portion 30 is positioned in the upper-lower direction.

In a state where the positioning is performed in this manner, the terminal accommodating block portion 20 completely passes through the through hole Pa when the connector 1 further moves forward in the fitting direction. When the rib 33 enters the recess Pb, two edges of the through hole Pa in the width direction are abutted against the engagement claw portion 36. With this done, the engagement claw portion 36 is elastically deformed inward in the width direction and the edges of the through hole Pa get over the elastically deformed engagement claw portion 36. Then, as shown in FIG. 5, the engagement claw portion 36 elastically returns and engages with the panel surface P2 of the panel P.

At this time, as shown in FIG. 5, a front end of the protrusion portion 31*b* of the arm-shaped locking portion 31 in the fitting direction (specifically, a front end of the connection wall 31*d* in the fitting direction) is abutted against the panel surface P1 of the panel P. That is, the connector 1 (more specifically, the panel assembly portion 30) is locked to the panel P so that the circumferential edge portion of the through hole Pa of the panel P is clamped between a pair of engagement claw portions 36 and four arm-shaped locking portions 31. Accordingly, the assembly of the connector 1 to the panel P is completed (the state shown in FIG. 4B).

Here, a distance a (see FIG. 2B) between the front end of the protrusion portion 31*b* in the fining direction and the engagement claw portion 36 is smaller than a thickness b of the panel P (see FIG. 5). Accordingly, in the state where the panel P is clamped by the engagement claw portion 36 and the arm-shaped locking portion 31 as is shown in FIG. 5, the arm-shaped locking portion 31 receives the external force F rearward in the fitting direction as indicated by an arrow in the drawing and is deformed to slightly bend rearward in the fitting direction. In other words, the arm-shaped locking portion 31 is elastically in contact with the panel surface P1 of the panel P. Accordingly, the rattling of the connector 1 relative to the panel P is prevented.

Figure 6A:
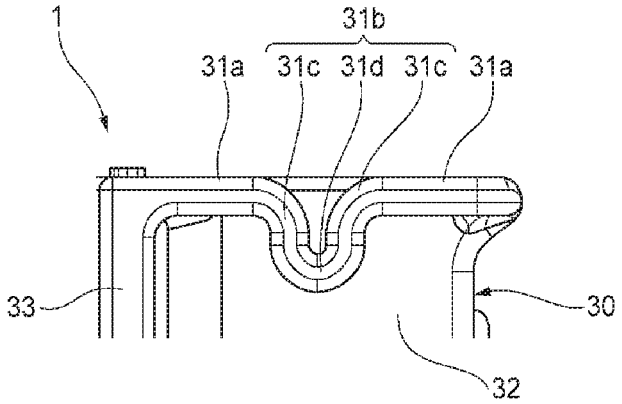
FIG. 6A is a top view showing a shape of the arm-shaped locking portion of the connector in FIG. 1 in a state where no external force is applied thereto.
Figure 6B:
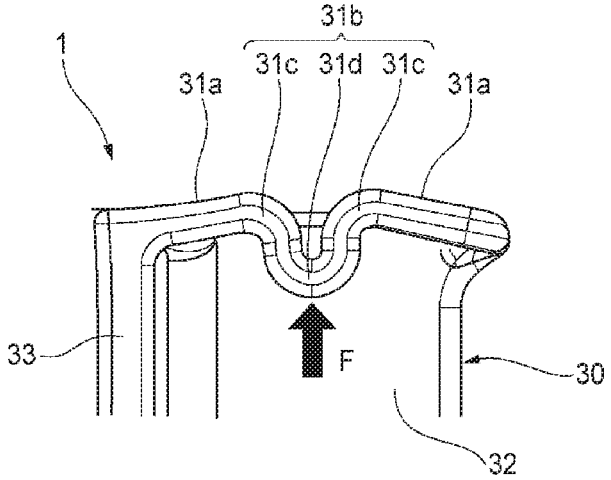
FIG. 6B is a schematic view showing a deformation status of the arm-shaped locking portion when an external force is applied thereto.

More specifically, when the external force F from the panel surface P1 reaches the front end of the coupling wall 31*d* in the fitting direction as is shown in FIGS. 6A and 6B, not only the pair of protruding walls 31*c* but also all of the coupling wall 31*d* and the beam-shaped portions 31*a* are curved. As a result, a distance between the pair of protruding walls 31*c* increases (that is, the gap expands). Then, the external force F from the panel surface P1 is moderately dispersed throughout the arm-shaped locking portion 31. As a result, for example, compared with a case where there is no gap between the pair of protruding walls 31*c*, stress concentration around the protrusion portion 31*b* is alleviated and the durability of the arm-shaped locking portion 31 against the external force F increases. Such a structure for alleviating the stress concentration has an effect of increasing the durability of the arm-shaped locking portion 31 as well even in a case where a large external force F is applied to the arm-shaped locking portion 31 when the connector 1 is assembled to the panel P.

As described above, according to the connector 1 in the present embodiment, the arm-shaped locking portion 31 that locks the connector 1 to the panel P has a shape of a double end-supported beam. Accordingly, even when the arm-shaped locking portion 31 is strongly pressed against the panel P when the connector 1 is assembled to the panel P, unintended damages or the like of the arm-shaped locking portion 31 can be prevented as compared with the connector in the related art. In this manner, the connector 1 has good durability for assembly to the panel P. In the present embodiment, the arm-shaped locking portion 31, which is one of the arm-shaped locking portion 31 and the engagement claw portion 36 that lock the connector 1 to the panel P, has the above-described shape of a double end-supported beam. However, both of the arm-shaped locking portion 31 and the engagement claw portion 36 of the connector 1 may have a shape of a double end-supported beam.

In the connector in the related art, electric wires and the like extending from the connector are caught by the cantilever-shaped locking arm, which may hinder assembly of the connector to the panel P. In contrast, the connector 1 according to the present embodiment includes the arm-shaped locking portion 31 having a shape of a double end-supported beam. Accordingly, it is less likely for the electric wires to hinder the assembly.

Further, the protrusion portion 31*b* constituting the arm-shaped locking portion 31 has a shape in which the pair of protruding walls 31*c* provided with a gap therebetween are connected by the connection wall 31*d*. Therefore, as compared with a case where there is no such gap, a force received by the protrusion portion 31*b* from the panel P is dispersed throughout the arm-shaped locking portion 31 when the arm-shaped locking portion 31 is abutted against the panel P and excessive stress concentration is less likely to occur around the protrusion portion 31*b*. Therefore, the connector 1 has better durability for assembly to the panel P.

Further, the beam-shaped portion 31*a* constituting the arm-shaped locking portion 31 has a shape extending from the panel assembly portion 30 so as to outwardly expand from an opening region of the through hole Pa. Therefore, the beam-shaped portion 31*a* can be made longer than in a case where the beam-shaped portion 31*a* has a length enough to fit within the opening region of the through hole Pa. As a result, a range in which the beam-shaped portion 31*a* is elastically deformable is widened and the durability for the assembly to the panel P can be further improved.

Other Embodiments

The present invention is not limited to the above embodiment and various modifications can be adopted within the scope of the present invention. For example, the present invention may be appropriately modified, improved or the like. In addition, materials, shapes, dimensions, numbers, arrangement locations and the like of elements in the above embodiment are optional and not limited as long as the object of the present invention can be achieved.

Here, characteristics of the embodiment of the connector 1 according to the present invention described above will be briefly summarized in the following [1] to [3].

[1] A connector (1) configured to be assembled to a plate-shaped panel (P) in a state of being inserted into a through hole (Pa) of the plate-shaped panel (P), the connector (1) comprising:

a body (30); and a first locking portion (31) and a second locking portion (36), wherein the body (30) is configured to be inserted into the through hole (Pa) in a predetermined insertion direction, wherein the first locking portion (31) and the second locking portion (36) are integrally provided with the body (30) and configured to be engaged with a circumferential edge portion of the through hole (Pa) in a state where the circumferential edge portion is clamped in the insertion direction, and wherein at least one of the first locking portion (31) and the second locking portion (36) has a shape of a double end-supported beam including a pair of beam-shaped portions (31*a*) extending from the body (30) and a protrusion portion (31*b*) connecting free ends of the pair of beam-shaped portions (31*a*) and protruding toward the panel (P).

[2] The connector (1) according to [1], wherein the protrusion portion (31*b*) comprises:

a first part (31*c*) connected to one of the pair of beam-shaped portions (31*a*) and extending toward the panel (P);

a second part (31*c*) connected to the other of the pair of beam-shaped portions (31*a*) and extending toward the panel (P); and a connection part (31*d*) defining a gap between the first part (31*c*) and the second part (31*c*) and connecting the first part (31*c*) and the second part (31*c*).

[3] The connector (1) according to [1] or [2], wherein at least one of the pair of beam-shaped portions (31*a*) has a shape extending from the body (30) so as to outwardly expand from an opening region of the through hole (Pa) when the connector (1) is assembled to the panel (P).

DESCRIPTION OF REFERENCE NUMERALS AND SIGNS

1 connector
2 connector body
20 terminal accommodating block portion
30 panel assembly portion (body)
31 arm-shaped locking portion (first locking portion)
31*a* beam-shaped portion
31*b* protrusion portion
36 engagement claw portion (second locking portion)
P panel
Pa through hole

What is claimed is:

1. A connector configured to be assembled to a plate-shaped panel in a state of being inserted into a through hole of the plate-shaped panel, the connector comprising:

a body; and a first locking portion and a second locking portion, wherein the body is configured to be inserted into the through hole in a predetermined insertion direction, wherein the first locking portion and the second locking portion are integrally provided with the body and configured to be engaged with a circumferential edge portion of the through hole in a state where the circumferential edge portion is clamped in the insertion direction, and wherein at least one of the first locking portion and the second locking portion has a shape of a double end-supported beam including a pair of beam-shaped portions extending from the body, and the at least one of the first locking portion and the second locking portion includes a protrusion portion connecting free ends of the pair of beam-shaped portions and protruding toward the plate-shaped panel.

2. The connector according to claim 1, wherein the protrusion portion comprises:

a first part connected to one of the pair of beam-shaped portions and extending toward the plate-shaped panel;

a second part connected to the other of the pair of beam-shaped portions and extending toward the plate-shaped panel; and a connection part defining a gap between the first part and the second part and connecting the first part and the second part.

3. The connector according to claim 1, wherein at least one of the pair of beam-shaped portions has a shape extending from the body so as to outwardly expand from an opening region of the through hole when the connector is assembled to the plate-shaped panel.

4. The connector according to claim 1, wherein the connector further comprises a rib extending from the body in parallel to the insertion direction, and wherein one of the pair of beam-shaped portions is continuous with the rib.

* * * * *